US009624853B2

(12) United States Patent
Dudar et al.

(10) Patent No.: US 9,624,853 B2
(45) **Date of Patent: *Apr. 18, 2017**

(54) SYSTEM AND METHODS FOR PURGING A FUEL VAPOR CANISTER

(71) Applicant: Ford Global Technologies, LLC, Dearborn, MI (US)

(72) Inventors: Aed M. Dudar, Canton, MI (US); Mark W. Peters, Wolverine Lake, MI (US); Richard Shimon, Royal Oak, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 67 days.

This patent is subject to a terminal disclaimer.

(21) Appl. No.: 14/656,459

(22) Filed: Mar. 12, 2015

(65) Prior Publication Data

US 2016/0265456 A1 Sep. 15, 2016

(51) Int. Cl.

| | |
|---|---|
| ***F02D 41/00*** | (2006.01) |
| ***F02M 25/08*** | (2006.01) |
| *F02D 41/08* | (2006.01) |

(52) U.S. Cl.

CPC ..... *F02D 41/004* (2013.01); *F02D 41/0035* (2013.01); *F02M 25/089* (2013.01); *F02M 25/0836* (2013.01); *F02M 25/0854* (2013.01); *F02D 41/08* (2013.01)

(58) Field of Classification Search

CPC ..... F02D 41/00; F02D 41/004; F02D 41/24; F02D 41/2406; F02D 41/26; F02M 25/08; F02M 25/0809; F02M 25/0836; F02M 25/0854; F02M 25/0863; F02M 25/0872

USPC ..... 701/102–104, 110–115; 123/516–521

See application file for complete search history.

(56) References Cited

U.S. PATENT DOCUMENTS

| | | | | |
|---|---|---|---|---|
| 3,888,223 | A * | 6/1975 | Mondt | F02M 25/089 123/519 |
| 5,183,023 | A | 2/1993 | Hanson | |
| 5,215,055 | A | 6/1993 | Orzel | |
| 5,754,971 | A | 5/1998 | Matsumoto et al. | |
| 5,755,854 | A | 5/1998 | Nanaji | |
| 5,918,580 | A | 7/1999 | Hennrich et al. | |
| 6,293,261 | B1 * | 9/2001 | Oemcke | F02M 25/0854 123/516 |
| 6,363,921 | B1 | 4/2002 | Cook et al. | |
| 7,131,322 | B2 | 11/2006 | Booms et al. | |

(Continued)

OTHER PUBLICATIONS

Dudar, A., "Systems and Methods for Reducing Bleed Emissions," U.S. Appl. No. 14/301,246, filed Jun. 10, 2014, pages.

(Continued)

*Primary Examiner* — John Kwon
*Assistant Examiner* — Johnny H Hoang
(74) *Attorney, Agent, or Firm* — James Dottavio; McCoy Russell LLP

(57) ABSTRACT

A method for purging a fuel vapor canister, comprising: responsive to an indication of vapor slugs, reversing a direction of air flow through the fuel vapor canister while maintaining purge air intake at a vent line inlet. By reversing the direction of air flow through the fuel vapor canister, the vapor slugs may be adsorbed within the fuel vapor canister and may not affect engine operation. In this way, purge operation may be maintained and emissions may be reduced.

19 Claims, 5 Drawing Sheets

(56) References Cited

U.S. PATENT DOCUMENTS

| | | | | |
|---|---|---|---|---|
| 7,284,541 | B1 | 10/2007 | Uchida | |
| 7,591,252 | B1 | 9/2009 | Park | |
| 7,810,475 | B2 | 10/2010 | Peters et al. | |
| 8,122,758 | B2 | 2/2012 | Wang et al. | |
| 8,327,691 | B2 | 12/2012 | Drane et al. | |
| 8,371,272 | B1 | 2/2013 | Martin et al. | |
| 8,371,273 | B2 | 2/2013 | Ulrey et al. | |
| 2002/0124836 | A1* | 9/2002 | Reddy | F02M 25/08 123/518 |
| 2009/0084363 | A1* | 4/2009 | Reddy | F02M 25/0854 123/520 |
| 2010/0223984 | A1* | 9/2010 | Pursifull | F02M 25/0836 73/114.39 |
| 2011/0030659 | A1* | 2/2011 | Ulrey | F02M 25/089 123/521 |
| 2014/0257668 | A1* | 9/2014 | Jentz | F02M 25/0809 701/102 |

OTHER PUBLICATIONS

Dudar, A., "Systems and Methods for Reducing Bleed Emissions," U.S. Appl. No. 14/495,796, filed Sep. 24, 2014, pages.

Anonymous, "Onboard Arbitration of Engine Lean DTCS P2196/P2198," IP.com No. 000234979, Published Feb. 20, 2014, 2 pages.

* cited by examiner

SYSTEM AND METHODS FOR PURGING A FUEL VAPOR CANISTER

FIELD

The present application relates to methods for purging a fuel vapor canister in an evaporative emissions system of a vehicle.

BACKGROUND AND SUMMARY

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical canister purge operation, a canister purge valve coupled between the engine intake and the fuel canister is opened, allowing for intake manifold vacuum to be applied to the fuel canister. Simultaneously, a canister vent valve coupled between the fuel canister and atmosphere is opened, allowing for fresh air to enter the canister. This configuration facilitates desorption of stored fuel vapors from the adsorbent material in the canister, regenerating the adsorbent material for further fuel vapor adsorption.

As fuel temperature rises during hot weather conditions, vehicle motion and resulting sloshing of fuel within the fuel tank may cause transient slugs of vapor. These vapor slugs from the fuel tank may enter the engine intake during a purge operation and cause engine stalling. As such, when presence of vapor slugs is deduced, the ongoing purge operation may be discontinued to reduce the likelihood of engine stalling. However, this suspension of the ongoing purge operation may lead to an increase in emissions. Further, a subsequent purge operation may have reduced efficiency due to the delay in ramping up the subsequent purge operation to the level of the previous discontinued purge operation. Further still, if the canister is not purged as frequently as demanded, the vehicle may not meet desired standards in an emissions test (e.g. Federal Test Procedure).

The inventors herein have recognized the above issues and have developed systems and methods to at least partially address them. In one example, a method for purging a fuel vapor canister comprises, responsive to an indication of vapor slugs, reversing a direction of air flow through the fuel vapor canister in a vehicle while maintaining purge air intake at a vent line inlet. By reversing the direction of air flow through the fuel vapor canister, the vapor slugs may be adsorbed in the fuel vapor canister.

In another example, a system for an engine comprises a fuel tank, a fuel vapor canister comprising a fuel vapor canister buffer coupled to the fuel tank, the fuel vapor canister buffer arranged at a first end of the fuel vapor canister, a purge line coupling the fuel vapor canister to an engine intake via a canister purge valve, a vent line coupling the fuel vapor canister to a fresh air source, a canister vent valve coupled between the fuel vapor canister and the vent line, the canister vent valve operable between a first conformation and a second conformation, a reversing valve coupled between the fuel vapor canister buffer and the purge line, the reversing valve operable between a first conformation and a second conformation, and a controller having executable instructions stored in a non-transitory memory for, when canister purge conditions are met, drawing air through the fuel vapor canister with the canister vent valve in the first conformation and with the reversing valve in the first conformation, and in response to inferring fuel vapor release higher than a threshold vapor release from the fuel tank, drawing air through the fuel vapor canister with the canister vent valve in the second conformation and with the reversing valve in the second conformation.

For example, a vehicle system may include an evaporative emissions system including a fuel vapor canister. The fuel vapor canister may include a fuel vapor canister buffer arranged at a first end of the fuel vapor canister. When purge conditions are met, fresh air may be drawn through the fuel vapor canister and may be streamed along with desorbed fuel vapors via the fuel vapor canister buffer at the first end of the fuel vapor canister towards an engine intake. A canister purge valve may be opened to enable the purge operation. During the purge, if a presence of vapor slugs is inferred by indication of fuel vapor release higher than a vapor release threshold, the purge direction may be reversed. Herein, fresh air may be drawn through the fuel vapor canister buffer at the first end of the fuel vapor canister, and may be streamed through the fuel vapor canister. Due to the reversing of purge direction, the vapor slug arriving at the fuel vapor canister buffer from the fuel tank may flow through the fuel vapor canister along with the fresh air and may be adsorbed. The fresh air along with desorbed vapors may exit the fuel vapor canister via an end opposite the first end of the fuel vapor canister towards the engine intake.

In this way, adverse effects of vapor slugs on engine operation may be reduced. By reversing the direction of purge flow in response to the indication of vapor slugs, the purge operation may be continued while simultaneously allowing the vapor slugs to be adsorbed in the fuel vapor canister. Thus, an engine stall due to a sudden increase in fuel vapor may be reduced. Further, by maintaining the purge operation, the fuel vapor canister may be evacuated fully. As such, purge efficiency may be improved. Overall, the performance of the evaporative emissions system may be more robust and efficient.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows an example engine system.

FIG. 2 schematically shows an example fuel system and an evaporative emissions system coupled to the example engine system of FIG. 1.

FIGS. 3A and 3B schematically show an evaporative emissions system in various states of operation according to the present disclosure.

DETAILED DESCRIPTION

This detailed description relates to systems and methods for managing fuel vapor in an evaporative emissions system.

Figure 2:
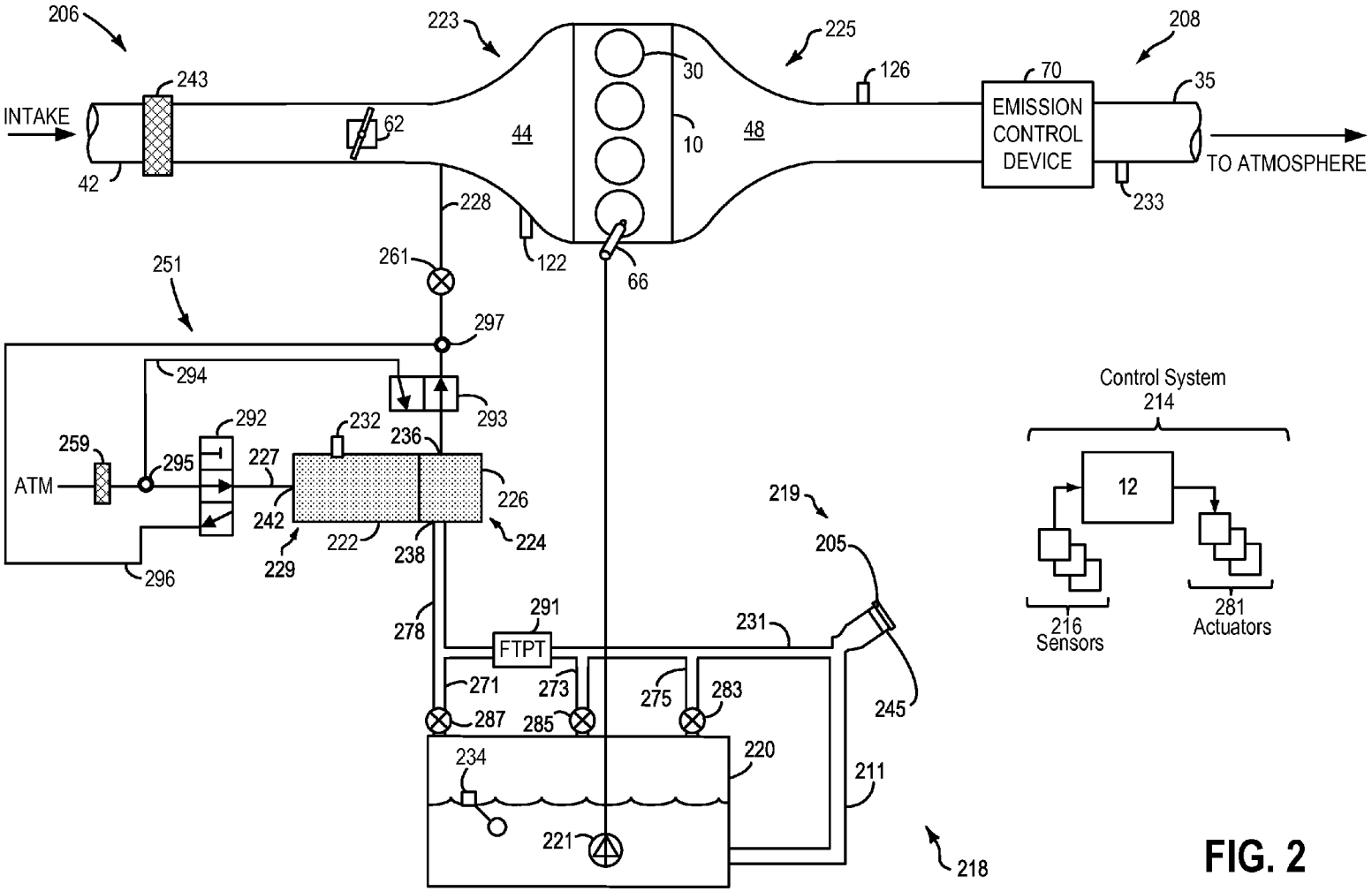
Figure 3A:
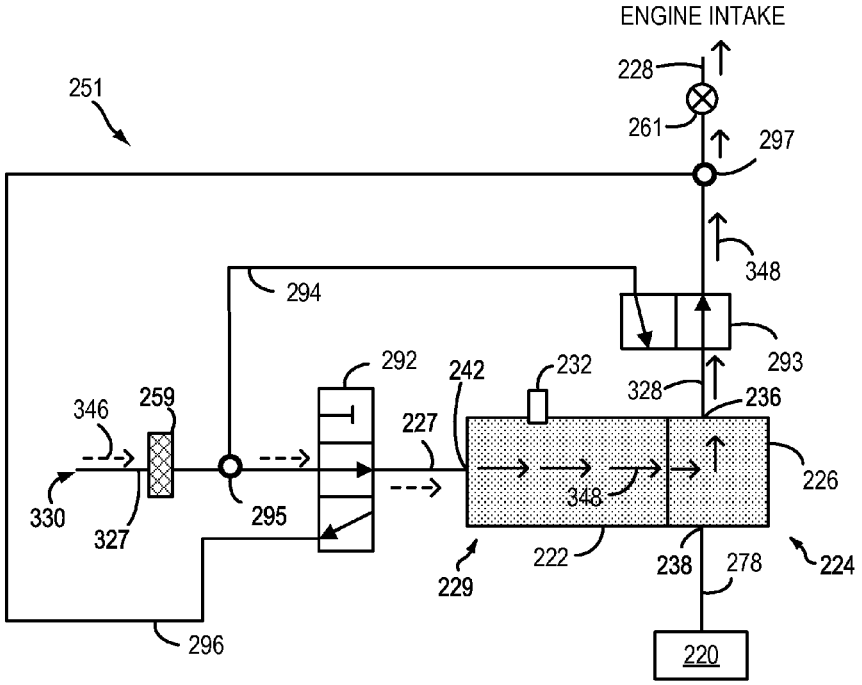
Figure 3B:
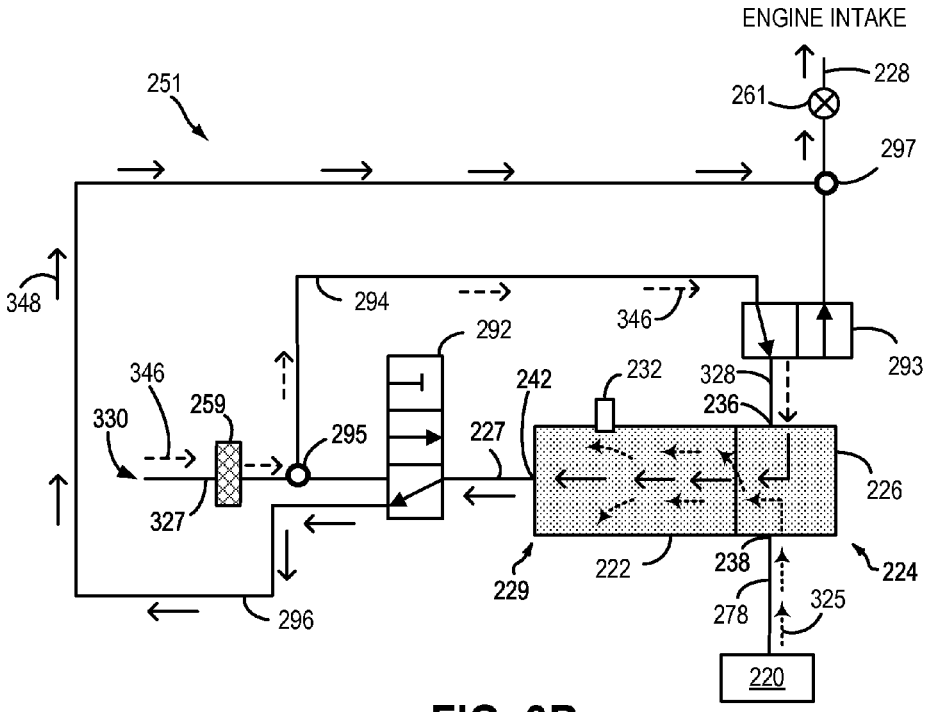
Figure 4:
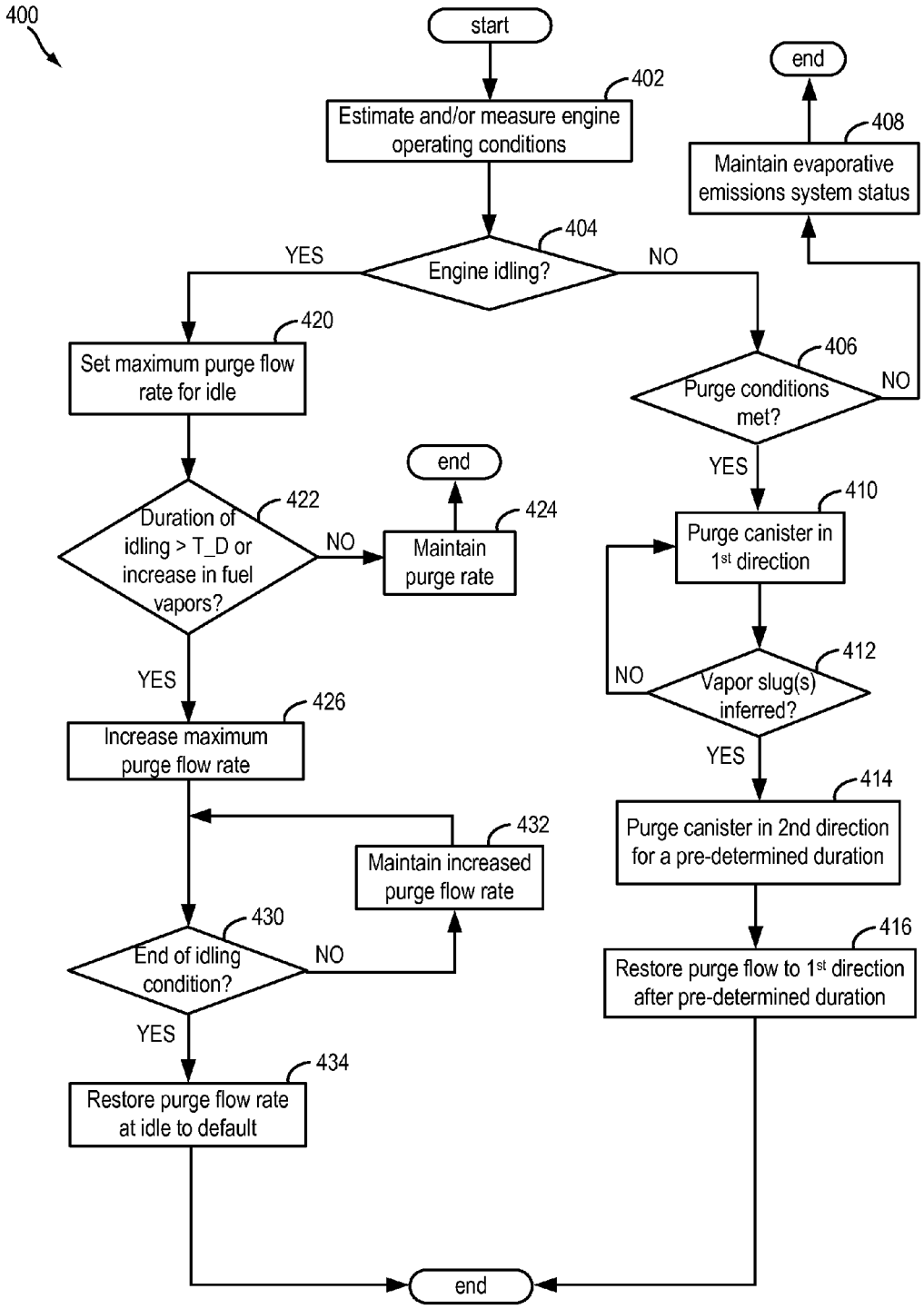
FIG. 4 shows an example flow chart for a high level method for purging a fuel vapor canister using the systems of FIGS. 2, 3A and 3B.
Figure 5:
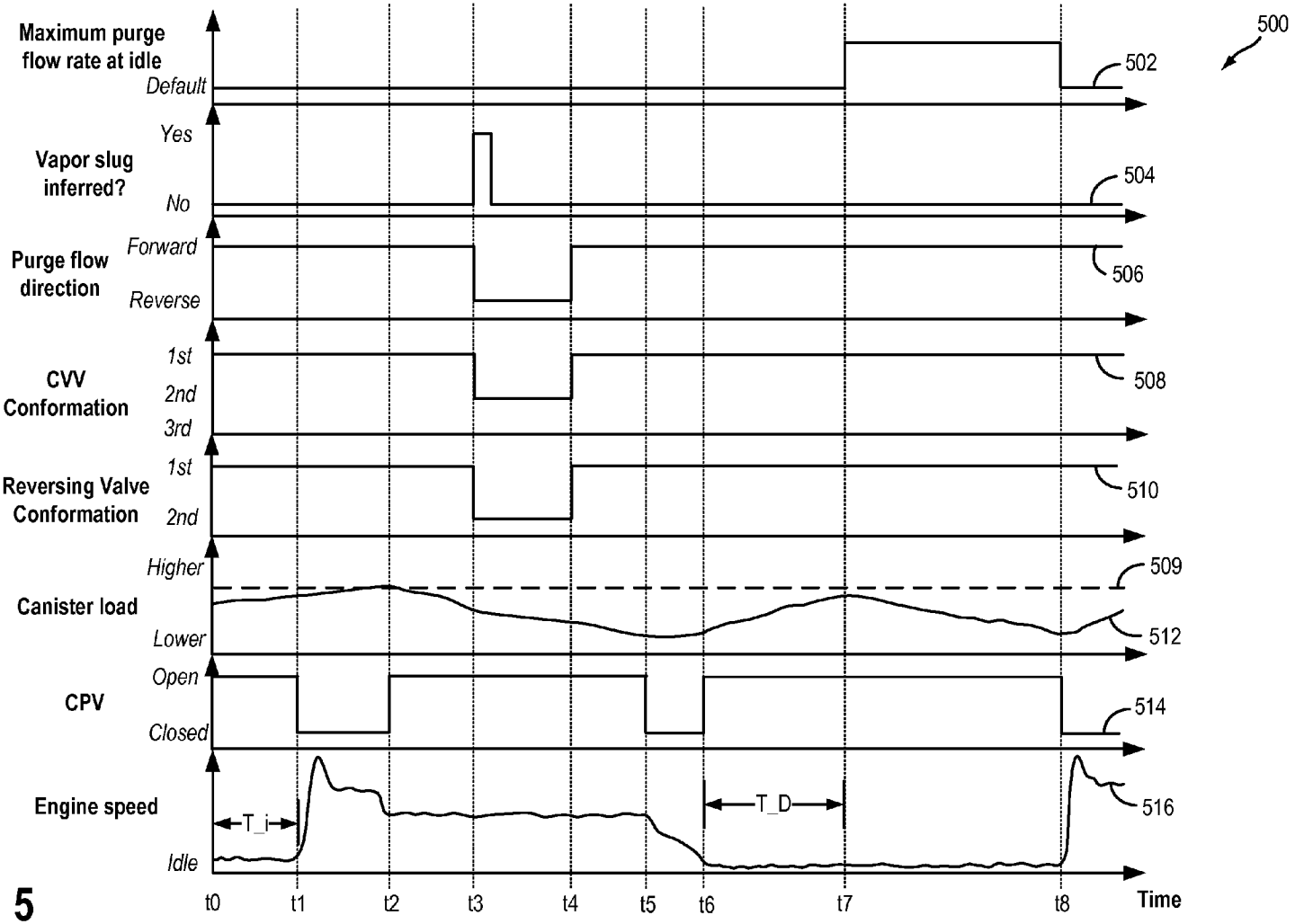
FIG. 5 shows an example timeline for canister purge during vehicle operation.

In particular, the description relates to reversing air flow through a fuel vapor canister in response to indication of vapor slugs in the fuel tank. The evaporative emissions system may be coupled to an engine, such as the engine system of FIG. 1, as shown in FIG. 2. The evaporative emissions system may include a fuel vapor canister coupled to a fuel tank such that fuel vapor may be discharged from the fuel tank without entering the atmosphere. The stored fuel vapors may be purged to the engine intake with fresh air drawn from atmosphere when purging conditions are met. FIGS. 3A-3B show depictions of an example fuel vapor canister and a system of conduits and valves for controlling the direction of flow of fresh air through the canister. Stored fuel vapor may be purged from the canister in two directions based on inferring the presence of vapor slugs (FIG. 4). Further, during an engine idling condition, an allowable idle purge flow rate may be set to a default rate. In response to a duration of engine idle being higher than a threshold duration, the idle purge flow rate may be increased. FIG. 5 shows an example timeline for a purge operation based on the presence of vapor slugs as well as purge operation during idling conditions.

Figure 1:
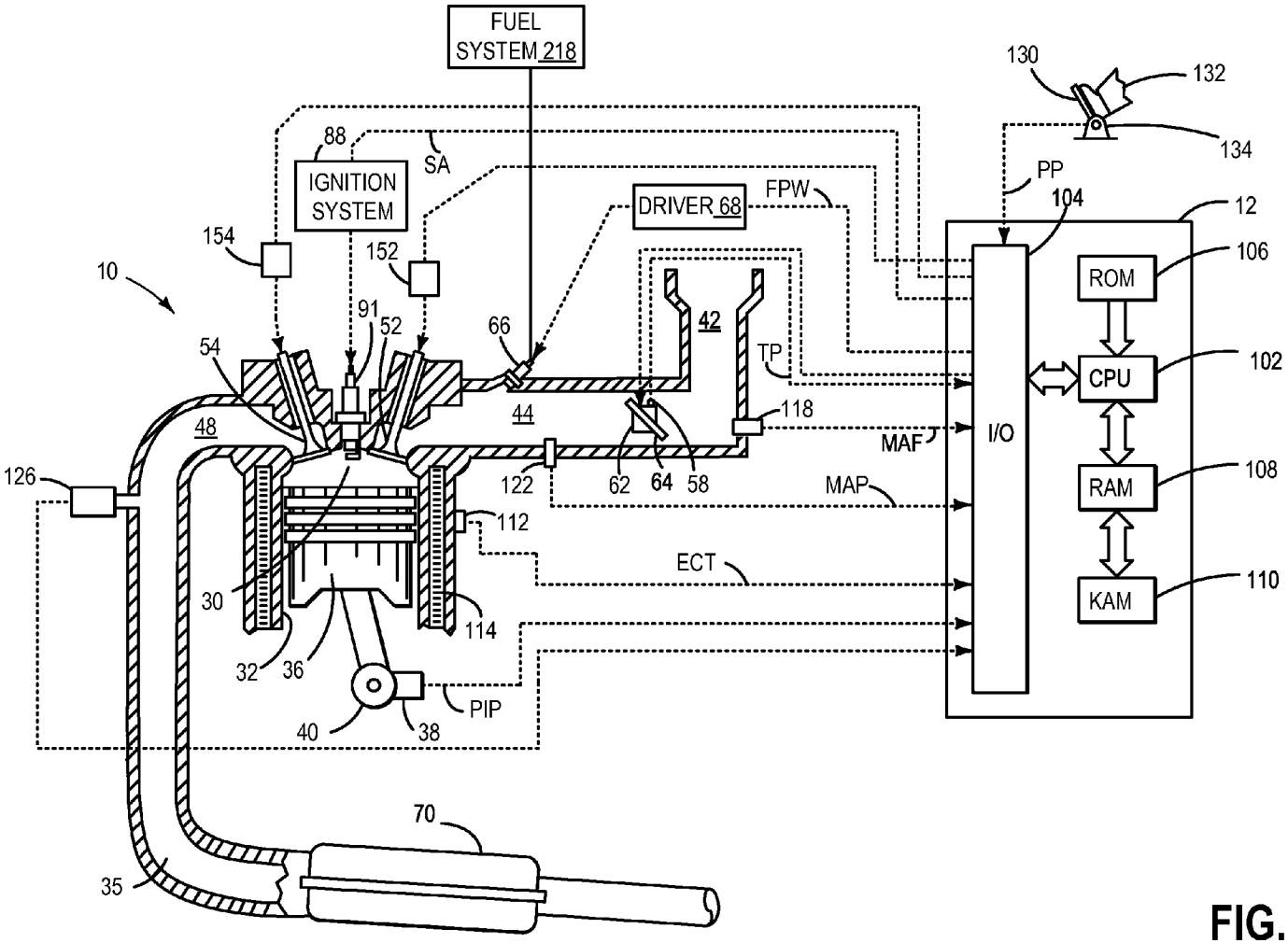

FIG. 1 is a schematic diagram showing one cylinder of multi-cylinder engine 10, which may be included in a propulsion system of a vehicle. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber 30 (also termed cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust manifold 48 and exhaust passage 35. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

A throttle 62 including a throttle plate 64 may be provided along intake passage 42 of engine 10 for varying the flow rate and/or pressure of intake air provided to cylinder 30. Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system 218 including a fuel tank, a fuel pump, and a fuel rail. Fuel system 218 will be described further in reference to FIG. 2 below. In some embodiments, combustion chamber 30 may alternatively or additionally include a fuel injector coupled directly to combustion chamber 30 for injecting fuel directly therein, in a manner known as direct injection.

Ignition system 88 can provide an ignition spark to combustion chamber 30 via spark plug 91 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 35 upstream of emission control device 70. In one example, sensor 126 may be a UEGO (universal or wide-range exhaust gas oxygen) sensor. Alternatively, any suitable sensor for providing an indication of exhaust gas air-fuel ratio such as a linear oxygen sensor, a two-state oxygen sensor or EGO, a HEGO (heated EGO), a NOx, HC, or CO sensor may be used. In some embodiments, exhaust gas sensor 126 may be a first one of a plurality of exhaust gas sensors positioned in the exhaust system. For example, additional exhaust gas sensors may be positioned downstream of emission control device 70.

Emission control device 70 is shown arranged along exhaust passage 35 downstream of exhaust gas sensor 126. Emission control device 70 may be a three way catalyst (TWC), NOx trap, various other emission control devices, or combinations thereof. In some embodiments, emission control device 70 may be a first one of a plurality of emission control devices positioned in the exhaust system. In some embodiments, during operation of engine 10, emission control device 70 may be periodically reset by operating at least one cylinder of the engine within a particular air-fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 (or other type) coupled to crankshaft 40; throttle position (TP) from a throttle position sensor 58; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 38, which is also used as an engine speed sensor, may produce a predetermined number of equally spaced pulses every revolution of the crankshaft.

FIG. 2 shows a schematic depiction of a vehicle system 206. The vehicle system 206 includes an engine system 208 coupled to an emissions control system 251 and a fuel system 218. Emission control system 251 (also termed evaporative emissions system 251) includes a fuel vapor container 222 (also termed fuel vapor canister 222) which may be used to capture and store fuel vapors. In some examples, vehicle system 206 may be a hybrid electric vehicle (HEV) system. In yet other examples, vehicle system 206 may be a plug-in hybrid electric vehicle (PHEV) system.

The engine system 208 may include engine 10 having a plurality of cylinders 30. Engine 10 of FIG. 2 may be the same as engine 10 of FIG. 1. Therefore, components previously introduced in FIG. 1 are numbered similarly and not described. Engine 10 includes an engine intake 223 and an engine exhaust 225. The engine intake 223 includes throttle 62 fluidly coupled to the engine intake manifold 44 via intake passage 42. Intake air may enter intake manifold 44 via one or more air filters 243. The engine exhaust 225 includes exhaust manifold 48 leading to exhaust passage 35 that routes exhaust gas to the atmosphere. The engine exhaust 225 may include one or more emission control devices 70, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 66 shown. While only a single injector 66 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 12. As depicted, fuel level sensor 234 may comprise a float connected to a variable resistor. Alternatively, other types of fuel level sensors may be used.

Vapors generated in fuel system 218 may be routed to an evaporative emissions control system 251 which includes fuel vapor canister 222 via vapor recovery line 231, before being purged to the engine intake 223. Vapor recovery line 231 may be coupled to fuel tank 220 via one or more conduits. For example, vapor recovery line 231 may be coupled to fuel tank 220 via one or more of a combination of conduits 271, 273, and 275.

Further, in some examples, one or more fuel tank vent valves may be includes in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283.

In one example, the vent valves (e.g., 287, 285, and 283) may be passive valves that block fluid (e.g., fuel) exiting the tank. These vent valves, however, may open responsive to fuel tank pressure above a threshold pressure. For example, when fuel temperature rises, sloshing of fuel within the fuel tank during vehicle motion can create an increase in fuel vaporization and therefore, an increase in fuel tank vapor pressure. Accordingly, one or more of the vent valves may open to relieve the pressure in the fuel tank. The release of vapor pressure from the fuel tank can cause one or more vapor slugs to be delivered to the canister. As such, the presence of vapor slugs may be inferred by a change in fuel tank pressure.

In some examples, recovery line 231 may be coupled to a fuel filler system 219 (also termed, refueling system 219). In some examples, fuel filler system may include a fuel cap 205 for sealing off the fuel filler system from the atmosphere. Refueling system 219 is coupled to fuel tank 220 via a fuel filler pipe 211 or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 12, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent. The canisters are configured to temporarily trap fuel vapors (including vaporized hydrocarbons) during fuel tank refilling operations and "running loss" (that is, fuel vaporized during vehicle operation). The canisters may also adsorb diurnal vapors. In one example, the adsorbent used is activated charcoal. Emissions control system 251 may further include a canister ventilation path or vent line 227 which may route gases out of the canister 222 to the atmosphere (ATM) when storing, or trapping, fuel vapors from fuel system 218.

Fuel vapor canister 222 may include a buffer 226 (or buffer region), each of the canister and the buffer comprising the adsorbent. Fuel vapor canister 222 may also be referred to simply as canister 222. Further, buffer 226 may also be termed fuel vapor canister buffer 226 herein.

As shown, the volume of buffer 226 may be smaller than (e.g., a fraction of) the volume of canister 222. The adsorbent in the buffer 226 may be same as, or different from, the adsorbent in the canister (e.g., both may include charcoal). Buffer 226 may be positioned at first end 224 of canister 222. First end 224 of canister 222 is situated opposite to second end 229 of canister 222. Canister 222 may not include a buffer at second end 229.

As such, buffer 226 may be arranged within canister 222 so that during canister loading, fuel tank vapors are first adsorbed within the buffer, and then when the buffer is saturated, further fuel tank vapors are adsorbed in the canister. As shown, fuel vapors may be received from fuel tank 220 into buffer 226 at third port 238. During canister purging, fuel vapors may first be desorbed from the canister (e.g., to a threshold amount) before being desorbed from the buffer. In other words, loading and unloading of the buffer is not necessarily linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may allow fresh air to be drawn into canister 222 when purging stored fuel vapors from fuel system 218 to engine intake 223 via purge line 228 and canister purge valve 261 (also termed, purge valve 261). For example, purge valve 261 may be normally closed but may be opened during certain conditions so that vacuum from engine intake manifold 44 is provided to the fuel vapor canister for purging. In some examples, vent line 227 may include an air filter 259 disposed therein upstream of canister 222.

In some examples, the flow of air and vapors between canister 222 and the atmosphere may be regulated by a canister vent valve 292 (also termed, vent valve 292) coupled within vent line 227. As shown in FIG. 2, vent valve 292 is a multi-position valve, movable between a first, second, and third position, allowing for the selection of different pathways for fresh air entering the canister. The conformation of vent valve 292 may be regulated in conjunction with the position of reversing valve 293. Example configurations are described further herein and with regard to FIGS. 3A-3B. Briefly, vent line 227 may be coupled to reversing valve 293 via conduit 294 and junction 295. Purge line 228 may be coupled to vent valve 292 via conduit 296 and junction 297. In the configuration shown in FIG. 2, fresh air may enter canister 222 via vent line 227, and exit buffer 226 into purge line 228. In a second configuration, fresh air entering vent line 227 may be ported across junction 295 through conduit 294 and reversing valve 293, entering fuel vapor canister buffer 226, and exiting fuel vapor canister 222 via conduit 296.

The canister vent valve may operable such that under default conditions, the canister is fluidically coupled with atmosphere via vent line 227 to enable venting of fuel tank 220 with the atmosphere. Fuel vapors from the fuel tank 220 may be vented towards fuel vapor canister 222, specifically, buffer 226, via conduit 278. Further, the fuel vapors may be adsorbed within buffer 226 and canister 222 and air may be vented to the atmosphere via vent line 227. When purge conditions are met, stored fuel vapors from canister 222 may be purged to engine intake 223 via canister purge valve 261.

Fuel system 218 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may close canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 12 may maintain canister purge valve 261 closed, to depressurize the fuel tank before enabling fuel to be added therein. As yet another example, the fuel system may be operated in a canister purging mode (e.g., after an emission control device light-off temperature has been attained and with the engine running), wherein the controller 12 may open canister purge valve 261. Herein, the vacuum generated by the intake manifold of the operating engine may be used to draw fresh air through vent line 227, via fresh air port 242, and through fuel vapor canister 222 to purge the stored fuel vapors across purge port 236 via purge line 228 into intake manifold 44. In this mode, the purged fuel vapors from the canister are combusted in the engine. The purging may be continued until the stored fuel vapor amount in the canister is below a threshold or until purging conditions are met. As described with regard to FIGS. 3A-3B and FIG. 4, the direction of the purge air flow may be reversed by altering the conformation of vent valve 292 and reversing valve 293.

Controller 12 may be included with control system 214. Control system 214 and controller 12 are shown receiving information from a plurality of sensors 216 (various examples of which are described herein) and sending control signals to a plurality of actuators 281 (various examples of which are described herein). As one example, sensors 216 may include exhaust gas sensor 126 located upstream of the emission control device, pressure sensor 291, canister temperature sensor 232, and other sensors described earlier in reference to FIG. 1. Additional sensors such as pressure, temperature, air/fuel ratio, and composition sensors may be coupled to various locations in the vehicle system 206. As another example, the actuators may include fuel injector 66, throttle 62, canister purge valve 261, and refueling lock 245. The controller 12 may receive input data from the various sensors, process the input data, and trigger the actuators in response to the processed input data based on instruction or code programmed therein corresponding to one or more routines. An example control routine is described herein with regard to FIG. 4.

Controller 12 receives signals from the various sensors of FIGS. 1 and 2 (e.g., MAF sensor 118 of FIG. 1) and employs the various actuators of FIGS. 1 and 2 (e.g., canister purge valve 261 of FIG. 2) to adjust engine operation as well as operation of emissions control system 251 based on the received signals and instructions stored on a memory of the controller.

Leak detection routines may be intermittently performed by controller 12 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Vent valve 292 may be placed in a third conformation, sealing the evaporative emissions system and decoupling the fuel vapor canister from atmosphere.

During conditions when bulk fuel temperature in the fuel tank rises or during vehicle motion when fuel sloshes within the fuel tank, a resulting increase in fuel pressure may be relieved by depressurizing the fuel tank. Depressurizing the fuel tank may cause one or more slugs of fuel vapor to be released towards the canister. Further, if the release of fuel vapor slugs into the canister is coincident with a purge operation (or the purge operation immediately follows the pressure release), the vapor slugs may be directed into the engine and the engine may stall. Accordingly, to reduce engine stalling and maintain the ongoing purge operation, purge flow through the canister may be reversed. The reversal may include changing the conformations of each of the vent valve 292 and the reversing valve 293, as will be described in reference to FIGS. 3A and 3B. Herein, fresh air may be drawn first through the buffer 226 via purge port 236 instead of via fresh air port 242. The purged vapors and air may exit the canister 222 via fresh air port 242.

In another example, fuel vaporization may increase during an extended engine idle and may considerably load the fuel vapor canister with fuel vapors. The canister may eventually bleed emissions if it is not purged sufficiently during engine idle. Accordingly, the idle purge flow rate may be increased if the engine is idling for longer durations.

It will be noted that the methods and systems described in the present disclosure may also be applied to a hybrid vehicle including PHEVs. Hybrid vehicles may include sealed fuel tanks which may be evacuated of pressure when fuel tank pressure rises above a threshold and the engine is combusting. A fuel tank isolation valve (FTIV) coupled to conduit 278 may be modulated to relieve the fuel tank pressure. The release of vapor pressure (e.g., flow of vapor slugs) into the engine, such as during a concurrent purging operation, may adversely affect drivability of the hybrid vehicle. In response to the release of fuel tank pressure, the purge flow within the canister in the hybrid vehicle may be reversed allowing the fuel vapors to traverse the canister length and be adsorbed.

Turning to FIGS. 3A-3B, the evaporative emissions system 251 is shown in two conformations. Components in FIGS. 3A and 3B are the same as the components of evaporative emissions system 251 in FIG. 2 and are numbered similarly.

Evaporative emissions system 251 comprises fuel vapor canister 222 coupled to a fuel vapor canister buffer 226. Fuel vapor canister buffer 226 is coupled to fuel tank 220 via conduit 278. In order to improve clarity of the following description, details of the vent valves and associated conduits are not depicted in FIGS. 3A and 3B. As such, canister 222 may be coupled to fuel tank 220 as described earlier in reference to FIG. 2. Further, a hybrid vehicle may include an FTIV coupled within conduit 278, and the FTIV may be operable to control the flow of fuel vapor out of the fuel tank. However, the depicted embodiment does not include an FTIV in conduit 278.

Fuel vapor canister buffer 226 is coupled to an engine intake (as shown in FIG. 2) via CPV 261 and purge line 228. CPV 261 and reversing valve 293 are shown coupled within purge line 228, and may be operable to control the flow of fuel vapor from the fuel vapor canister to the engine intake. Fuel vapor canister 222 is fluidically coupled to atmosphere via vent line 227. Vent valve 292 is shown fluidically coupled within vent line 227, and may be operable to control the flow of fresh air into fuel vapor canister 222 and fuel vapor canister buffer 226. Vent line 227 is shown coupled to reversing valve 293 via conduit 294 and junction 295. Purge line 228 is shown coupled to vent valve 292 via conduit 296 and junction 297. The portion of vent line 227 located between junction 295 and vent line inlet 330 is designated as vent line segment 327 and may include air filter 259. Fresh air may be drawn into vent line segment 327 via vent line inlet 330. The portion of purge line 228 located between reversing valve 293 and fuel vapor canister buffer 226 is designated as purge line segment 328. Purge line segment 328 is coupled to fuel vapor canister buffer 226 at a first port 236 (also termed, purge port 236). Vent line 227 is coupled to fuel vapor canister 222 at a second port 242 (also termed, fresh air port 242). Conduit 278 is coupled to fuel vapor canister buffer 226 at a third port 238 (also termed, fuel vapor port 238). Canister 222 may be coupled to one or more canister temperature sensors such as sensor 232. Purge line 228 may be coupled to one or more oxygen sensors and/or one or more hydrocarbon sensors (not shown).

In FIG. 3A, vent valve 292 is shown in a first conformation and reversing valve 293 is shown in a first conformation. By placing the vent valve 292 and the reversing valve 293 in their respective first conformations at the same time, purge flow in a forward direction may occur. In this example, canister purge valve 261 may be considered open, and the intake manifold may comprise a vacuum sufficient to execute a purging operation. Further, engine conditions may enable canister purge. When vent valve 292 is in the first conformation, fuel vapor canister 222 is fluidically coupled to atmosphere via each of vent line 227 and vent line segment 327. When reversing valve 293 is in the first conformation, fuel vapor canister buffer 226 is fluidically coupled to the engine intake via each of purge line 228 and purge line segment 328 when purge valve 261 is open. As engine intake vacuum is applied to evaporative emissions system 251, fresh air 346 enters vent line segment 327 via vent line inlet 330, passes across junction 295, flows through vent valve 292 and vent line 227 into fresh air port 242 and thereon into fuel vapor canister 222. Fresh air entering canister 222 may promote desorption of adsorbed fuel vapors within canister 222 and within buffer 226. The purge gasses 348, including fresh air and desorbed fuel vapors, will then enter purge line segment 328 via purge port 236, passing through reversing valve 293, and purge valve 261 through purge line 228 en route to engine intake. Thus, a first direction of purge flow (herein, the forward flow) with the vent valve 292 and the reversing valve 293 in their respective first conformations may include fresh air entering fuel vapor canister 222 through second port 242 and exiting fuel vapor canister buffer 226 via first port 236. Thus, the first direction of purge flow includes purge flow from second port 242 to first port 236. Specifically, fresh air 346 flows at first through fuel vapor canister 222 and then the mix of fresh air and desorbed vapors (denoted as purge gasses 348) exit through fuel vapor canister buffer 222. The first direction of purge flow may also be termed forward direction of purge flow.

As such, the configuration shown in FIG. 3A allows for fuel vapor canister purging via the flow path indicated by the arrows (dashed and solid arrows) including arrows representing fresh air 346 and purge gasses 348.

The direction of air flow (and purge flow) through the canister may be reversed in response to an inference of vapor slugs. The presence of vapor slugs may be inferred by sudden changes in vehicle speed and/or changes in fuel tank pressure. Vehicle motion may cause fuel sloshing within the tank that can increase fuel vapor formation. Likewise, higher ambient temperatures may also increase fuel vaporization within the fuel tank. The increase in fuel vapors may raise fuel tank pressure whereupon the fuel tank may be depressurized to release slugs of fuel vapor into the canister. Vapor slugs may, in one example, include large bubbles of vapor. In another example, vapor slugs may be transient flows of concentrated fuel vapor. The sudden changes in fuel tank pressure and/or vehicle speed may indicate imminent release of vapor slugs. To elaborate, the indication of vapor slugs may signify release of an amount of fuel vapors from the fuel tank that is higher than a threshold amount. Alternatively, vapor slugs may be inferred based on a fuel vapor release that is higher than a threshold vapor release T_VR.

During a purge operation with purge flow in the first direction shown in FIG. 3A, if vapor slugs are received from fuel tank 220 into fuel vapor canister buffer 226 via conduit 278, these vapor slugs may combine with purge gasses 348 and enter the engine intake via purge line 228. The additional fuel vapors, in the form of vapor slugs, in these purge gasses may adversely affect air-fuel ratio and engine operation. By reversing the purge flow in response to an indication of vapor slugs, the fuel vapors may be adsorbed within canister 222, as will be described further below.

FIG. 3B shows vent valve 292 in a second conformation and reversing valve 293 in a second conformation. In this example, purge valve 261 may be considered open, and the intake manifold may comprise a vacuum sufficient to execute a purging operation. When in this configuration, fuel vapor canister buffer 226 is fluidically coupled to atmosphere via purge line segment 328, conduit 294, and vent line segment 327, while fuel vapor canister 222 is fluidically coupled to engine intake via vent line 227, conduit 296, and purge line 228. As engine intake vacuum is applied to evaporative emissions system 251, fresh air 346 enters vent line segment 327 at vent line inlet 330, passes through junction 295 to conduit 294. The fresh air 346 then passes through reversing valve 293 and purge line segment 328 into fuel vapor canister buffer 226. In this way, the direction of air flow through the fuel vapor canister is reversed as opposed to the conformation shown in FIG. 3A, while the purge air intake is maintained at vent line inlet 330. Fresh air 346 entering buffer 226 will promote desorption of adsorbed fuel vapor within buffer 226 and within canister 222.

FIG. 3B also depicts fuel vapor 325 (as part of one or more vapor slugs) from fuel tank 220 streaming along conduit 278 and entering buffer 226 via third port 238. Due to the reversed purge flow direction in fuel vapor canister 222, fuel vapors 325 traverse the buffer 226 and the fuel vapor canister 222 along with fresh air 346 towards second port 242. Specifically, fuel vapors 325 entering buffer 226 via third port 238 may not flow towards first port 236. As the fuel vapors stream through the canister 222, at least a portion of the fuel vapors 325 within the one or more vapor slugs is adsorbed within buffer 226 and fuel vapor canister 222. Simultaneously, fresh air 346 entering buffer 226 may also purge desorbed fuel vapors (that were previously stored within buffer 226 and fuel vapor canister 222). Thus, purge gasses 348 comprising a mix of fresh air 346 and desorbed fuel vapors enter vent line 227 via second port 242. Though not shown, the purge gasses may include a smaller proportion of fuel vapors 325 received as one or more vapor slugs from fuel tank 220. Purge gasses 348 flow through vent line 227, across vent valve 292 into conduit 296. The purge gasses 348 then pass through junction 297 and purge valve 261 into purge line 228 and thereon to the engine intake.

In this way, although the direction of air flow through the canister is reversed when compared to the configuration shown in FIG. 3A, the delivery of purge gasses to engine intake is maintained. Further, the one or more vapor slugs received from the fuel tank may be adsorbed within canister 222 as the fuel vapors 325 are impelled to traverse the length of canister 222. Further still, these vapor slugs may not flow into the engine intake via purge port 236. As such, the purge operation may be maintained in an uninterrupted manner.

Thus, a second direction of purge flow with the vent valve 292 and the reversing valve 293 in their respective second conformations may include fresh air entering fuel vapor canister buffer 226 through first port 236 and purge gasses exiting fuel vapor canister 222 via second port 242. Thus, the second direction of purge flow includes purge flow from first port 236 to second port 242. Specifically, fresh air 346 flows at first through fuel vapor canister buffer 226 and then the mix of fresh air and desorbed vapors (denoted as purge gasses 348) as well as a smaller proportion of fuel vapors 325 may exit through second end 229 of fuel vapor canister 222. Further, it will be appreciated that the second direction of purge flow is opposite to the first direction of purge flow.

Though not shown, vent valve 292 may be placed in a third conformation while reversing valve 293 is in a first conformation for performing leak tests. While vent valve 292 is in the third conformation, vent line 227 is sealed, decoupling canister 222 from atmosphere. Further, purge valve 261 may be open and with reversing valve 293 in the first conformation, a vacuum may be drawn on fuel vapor canister 222 and fuel vapor canister buffer 226. If the system pressure reaches a threshold, the system may be considered to be intact.

Thus, an example system for an engine may comprise a fuel tank, a fuel vapor canister comprising a fuel vapor canister buffer coupled to the fuel tank, the fuel vapor canister buffer arranged at a first end of the fuel vapor canister, a purge line coupling the fuel vapor canister to an engine intake via a canister purge valve, a vent line coupling the fuel vapor canister to a fresh air source (e.g. the atmosphere), a canister vent valve coupled between the fuel vapor canister and the vent line, the canister vent valve operable between a first conformation and a second conformation, a reversing valve coupled between the fuel vapor canister buffer and the purge line, the reversing valve operable between a first conformation and a second conformation, and a controller having executable instructions stored in a non-transitory memory for, when canister purge conditions are met, drawing air through the fuel vapor canister with the canister vent valve in the first conformation and with the reversing valve in the first conformation (as shown in FIG. 3A) and in response to inferring fuel vapor release higher than a threshold vapor release from the fuel tank, drawing air through the fuel vapor canister with the canister vent valve in the second conformation and with the reversing valve in the second conformation (as shown in FIG. 3B). Drawing air through the fuel vapor canister may further comprise opening the canister purge valve. The canister vent valve may fluidically couple the fuel vapor canister to the fresh air source when in the first conformation, and when in the second conformation, the canister vent valve may fluidically couple the fuel vapor canister to the purge line. The reversing valve may fluidically couple the fuel vapor canister buffer to the purge line when in the first conformation, and when in the second conformation, the reversing valve may fluidically couple the fuel vapor canister buffer to the fresh air source.

Further an example method for purging a fuel vapor canister may comprise coupling a first fuel vapor canister port (e.g., purge port 236) to an engine intake, coupling a second fuel vapor canister port (e.g., second port 242) to a fresh air source, opening a canister purge valve coupled between the first fuel vapor canister port and the engine intake, and responsive to an indication of fuel vapor release from a fuel tank higher than a threshold vapor release, coupling the second fuel vapor canister port to the engine intake and coupling the first fuel vapor canister port to the fresh air source. Herein, the first fuel vapor canister port may be coupled to a fuel vapor canister buffer, and the second fuel vapor canister port may not be coupled to the fuel vapor canister buffer. The first fuel vapor canister port may be fluidically coupled to the engine intake by a reversing valve (e.g., 293) in a first conformation coupled between the fuel vapor canister and the engine intake. The second fuel vapor canister port may be fluidically coupled to the fresh air source by a canister vent valve (e.g., 292) in a first conformation coupled between the fuel vapor canister and the fresh air source. Coupling the second fuel vapor canister port to the engine intake and coupling the first fuel vapor canister port to the fresh air source may include adjusting the reversing valve to a second conformation and concurrently adjusting the canister vent valve to a second conformation, respectively. Adjusting the reversing valve to the second conformation and simultaneously adjusting the canister vent valve to the second conformation may reverse a direction of air flow through the fuel vapor canister compared to placing the reversing valve in the first conformation and placing the canister vent valve in the first conformation.

Turning now to FIG. 4, it shows an example flow chart for a high-level method 400 for a canister purge routine. Specifically, method 400 reverses purge flow direction in response to indication of vapor slugs. Further, method 400 may also modify a maximum purge flow rate during idle based on a duration of engine idle.

Method 400 will be described in reference to the system described in FIGS. 1, 2, 3A and 3B, though it should be understood that method 400 may be applied to other systems without departing from the scope of this disclosure. Method 400 may be carried out by a controller (e.g., controller 12 of FIGS. 1 and 2), and may be stored as executable instructions in non-transitory memory.

Instructions for carrying out method 400 herein may be executed by a controller, such as controller 12 of FIGS. 1 and 2, based on instructions stored on a memory of the controller and in conjunction with signals received from various sensors, such as the sensors described above with reference to FIGS. 1 and 2, of the engine system (such as example engine 10 of FIG. 1) and the emissions control system (e.g., emissions control system 251 of FIG. 2). The controller may employ engine actuators of the engine system to adjust engine operation, according to method 400 described below.

At 402, method 400 may estimate and/or measure engine operating conditions. Operating conditions may be measured, estimated or inferred, and may include various vehicle conditions, such as vehicle speed and vehicle location, various engine operating conditions, such as engine operating mode, engine speed, engine temperature, exhaust temperature, boost level, MAP, MAF, torque demand, etc., and various ambient conditions, such as temperature, barometric pressure, humidity, date, time, etc. In addition to engine conditions, fuel system conditions may also be monitored, such as fuel tank pressure, canister temperature, canister load, etc.

Next at 404, method 400 may determine if engine idling conditions are present. For example, an engine may be considered to be idling when engine speed is substantially equivalent to an idle speed. In another example, the engine may be determined to be idling when the accelerator pedal is fully released, vehicle speed is substantially zero, and engine speed is at idle speed. If idling conditions are not determined, method 400 continues to 406 to determine whether canister purge conditions are met. Purge conditions may include an engine-on condition, a canister load above a threshold load, an intake manifold vacuum above a threshold level, sufficient duration since a previous purge operation, and other operating conditions.

If purge conditions are met, method 400 may proceed to 410 to commence purging the fuel vapor canister in a first direction. Referring to FIG. 3A, purging the fuel vapor canister in the first direction may include drawing fresh air through vent line inlet 330, vent line segment 327, and vent line 227 such that the fresh air 346 enters fuel vapor canister 322 via second port 242. Further, this fresh air may stream through the canister (including the buffer) along with desorbed fuel vapors as purge gasses 348 and may exit fuel vapor canister 222 via the fuel vapor canister buffer 226 at purge port 236, along purge line segment 328, and purge line 228 before flowing to the engine intake. Purging the fuel vapor canister in the first direction may include placing vent valve 292 in its first conformation concurrently with placing reversing valve 293 in its respective first conformation. CPV 261 may also be opened, coupling the fuel vapor canister to engine intake via purge port 236.

If purge conditions are not met, method 400 continues to 408 to maintain an existing status of the evaporative emissions system (e.g., 251). As such, a purge operation may not be enabled. Further, method 400 may end.

Returning to 410, method 400 may continue from 410 to 412 to determine if fuel vapor release is higher than a threshold vapor release, T_VR. As such, 412 may determine if a vapor slug is (or vapor slugs are) inferred. As described earlier, a vapor slug may include a concentrated flow of fuel vapors in transient mode. The presence of vapor slugs, or an impending presence of vapor slugs, may be inferred by detecting one or more of a change in vehicle speed and a change in fuel tank pressure. For example, the change in vehicle speed may be an abrupt increase in vehicle speed. In another example, a sudden decrease in vehicle speed may also indicate an impending vapor slug release. In yet another example, a sudden increase in fuel tank pressure as measured by pressure sensor 291 may denote an upcoming vapor slug release from the fuel tank. In still another example, detecting a release of an amount of fuel vapors from the fuel tank that is higher than a threshold amount may also indicate a presence of vapor slugs.

If the presence of vapor slug(s) is not inferred, method 400 returns to 410 to continue purging the fuel vapor canister in the first direction. Alternatively, if the impending release of vapor slugs is inferred, method 400 continues to 414 to purge the fuel vapor canister in the second direction. Specifically, the purge flow direction is reversed from the first direction such that the purge flow occurs in an opposite direction to that of the first direction. As described earlier in reference to FIG. 3B, fresh air 346 is drawn into buffer 226 via purge port 236 and a mix of fresh air along with desorbed vapors flows towards second port 242. Further, fuel vapors 325 in the vapor slug enters the fuel vapor canister buffer 226 via third port 238 and flows along with fresh air and desorbed vapors towards the second port 242. As fuel vapors 325 stream through the buffer and the canister, they may be adsorbed and stored within the canister. This adsorption reduces a likelihood of the concentrated fuel vapors in the vapor slug entering the engine intake. As such, a larger proportion of the fuel vapors from the vapor slug(s) may be adsorbed within the canister. However, previously stored vapors and fresh air may exit the fuel vapor canister 222 via second port 242 as purge gasses 348.

Further, method 400 may enable purge flow in the second direction at 414 for a pre-determined duration. The pre-determined duration may be based upon one or more of sensor outputs. For example, the canister temperature sensor may indicate an increase in temperature while fuel vapors are being adsorbed, and may plateau when fuel vapor is no longer being adsorbed. In another example, the change in fuel tank pressure during vapor slug release may provide an indication of the pre-determined duration. In yet another example, purge flow in the second direction may be terminated earlier than the pre-determined duration if purging conditions are no longer met. For example, if intake manifold vacuum level decreases, the purge operation may be ended.

At 416, the purge direction may be restored to the first direction after the pre-determined duration is completed. Thus, after an elapse of the pre-determined duration, fresh air may not be drawn into the fuel vapor canister with the canister vent valve in the second conformation and with the reversing valve in the second conformation. Specifically, vent valve 292 and reversing valve 293 may be adjusted to their respective first conformations enabling purge flow in a forward or in the first direction. Method 400 may then end.

Returning to 404, if engine idling conditions are confirmed, method 400 continues to 420 to set the maximum purge flow rate to a default purge flow rate at idle. The default purge flow rate may allow a smaller proportion of purge gasses to enter the engine intake. Next, at 422, method 400 may confirm if the duration of engine idling is higher than a threshold duration, T_D. As such, as a duration of engine idle increases, fuel vaporization within the fuel tank may increase, and the canister may be loaded substantially. The threshold duration, in one example, may be 15 minutes. In another example, the threshold duration may be 10 minutes. Additionally or alternatively, method 400 may also confirm at 422 if an increased production of fuel vapors is estimated. The increased production of fuel vapors may, in one example, be identified by measuring canister load. In another example, the rise in fuel vapors may be determined by monitoring fuel tank pressure. If it is determined either that idling duration is shorter than T_D or that the increase in vapors production is below a vapor threshold, method 400 progresses to 424 to maintain the default idle purge flow rate, and method 400 may then end.

However, if it is determined at 422 that either the duration of idle is higher than the threshold duration, T_D, or that an amount of vapor production is higher than the vapor threshold, method 400 continues to 426 to temporarily increase the maximum purge flow rate at idle. Specifically, the idle purge flow rate is increased. To elaborate, the idle purge flow rate may be increased relative to the default idle purge flow rate. For example, a duty cycle of the canister purge valve 262 may be increased.

Next, at 430, method 400 may determine if the engine idle condition is concluded. For example, it may be determined that the engine is not idling when the accelerator pedal is depressed e.g. as at a tip-in event. In another example, releasing a brake pedal (and/or a parking brake) may indicate that the engine idle condition may be ended presently. If yes, method 400 continues to 434 to restore the idle purge flow rate to default maximum idle purge flow rate. If not, method 400 proceeds to 432 to maintain the increased purge flow rate at idle.

In this way, canister loading during extended idle conditions may be reduced. As such, bleed emissions may be diminished allowing vehicle emissions compliance. Further, an emissions increase due to the release of vapor slugs may be mitigated by reversing the direction of purge flow.

FIG. 5 shows an example canister purge operation during non-idle and idle conditions. Map 500 depicts a maximum purge flow rate at idle at plot 502, inference of vapor slug at plot 504, purge flow direction at plot 506, conformation of the canister vent valve (CVV) at plot 508, conformation of the reversing valve at plot 510, canister load at plot 512, a state of the canister purge valve (CPV) at plot 514, and engine speed at plot 516. Line 509 represents a threshold load for the canister. The above plots are plotted against time on the x-axis. As such, time increases from the left to the right along the x-axis.

At t0, the engine may be idling as denoted by engine speed at idle speed. Canister load is substantially close to the threshold load (line 509), and the CPV may be maintained open to enable a default idle purge flow rate. As such, the purge flow into the intake may be at a lower rate. The CVV and reversing valve are both in their respective first conformation, as shown by plots 508 and 510, respectively and purge flow occurs in the forward or the first direction (as shown in FIG. 3A). Even though a smaller purge flow occurs between t0 and t1, the canister load may increase gradually as indicated by plot 512.

At t1, a tip-in event may occur as indicated by the rapid rise in engine speed immediately following t1. For example, an operator torque demand may increase in order to accelerate the vehicle to merge onto a highway. In response to the rise in engine speed, the purge operation in the first direction may be terminated by closing the CPV at t1. However, the CVV may be maintained in the first conformation, and the reversing valve may be maintained in its first conformation. Canister load may continue to increase between t1 and t2. It will be noted that the duration spent at engine idle is T_i (between t0 and t1) which may be lower than the threshold duration, T_D. Accordingly, the maximum purge flow rate at idle may remain at default rate and may not be increased between t0 and t1.

Between t1 and t2, engine speed may stabilize such that at t2, a steady state driving condition may be reached. Further, at t2, canister load is at or slightly higher than threshold load (line 509). Accordingly, the CPV may be opened. Since the CVV and the reversing valve are in their respective first conformations, purge flow occurs in the first direction (or forward direction). As the CPV is opened, fresh air may be drawn into the fuel vapor canister (via the second end, e.g. 229 of canister 222) enabling desorption of stored fuel vapors. Further, the desorbed fuel vapors may exit the fuel vapor canister buffer arranged at the first end of the fuel vapor canister towards the engine intake. In response to the purge flow in the forward direction, the canister load decreases, as indicated by plot 512.

At t3, a vapor slug may be inferred as shown by plot 504. As mentioned earlier, vapor slug(s) may be inferred based on sudden changes in vehicle speed and/or fuel tank pressure. For example, an unexpected rise in fuel tank pressure may indicate incoming vapor slugs. Herein, the rise in fuel tank pressure may be relieved resulting in a release of fuel vapors from the fuel tank in the form of one or more vapor slugs. As such, the release of fuel vapors may be higher than a threshold amount indicating presence of vapor slugs.

In response to the indication of vapor slugs, each of the CVV and the reversing valve is switched to its respective second conformation at t3. Consequently, purge flow may now occur in the reverse direction. Specifically, fresh air may now be drawn into the fuel vapor canister buffer and may exit along with desorbed vapors via the second end of the fuel vapor canister (e.g., second end 229 of canister 222). Further, fuel vapors in the vapor slug may flow through the fuel vapor canister and may be adsorbed within the fuel vapor canister. Accordingly, the canister load decreases slightly between t3 and t4 as previously stored vapors in the canister may be desorbed at the same time as vapors from the vapor slug are adsorbed within the fuel vapor canister.

The reversed direction of purge flow may be held for a pre-determined duration, such as the duration between t3 and t4. In one example, purge flow may be reversed for a duration based upon a measurement of change in fuel tank pressure when the vapor slug was released. In another example, the change in vehicle speed may determine the duration that purge flow is reversed. In yet another example, canister temperature may be monitored to determine termination of reversed purge flow. At t4, reverse purge flow may be switched to purge flow in the forward direction by adjusting the CVV and the reversing valve to their respective first conformations. Purge flow may continue in the forward (or first) direction until t5 when engine speed is decreased at an approaching vehicle stop. Due to the change in engine condition, the CPV is closed at t5 and purge flow may be stopped between t5 and t6.

The engine may begin idling at t6 as indicated by engine speed at idle speed (plot 516). Herein, the vehicle may be at rest while the engine is operating at idle. Accordingly, the CPV may be opened and the purge flow rate may be set at the default maximum purge flow rate for idling conditions (plot 502). Since the CVV and the reversing valve are in their respective first conformations, purge flow may occur in the forward direction.

At t7, it may be determined that the engine idling duration is at the threshold duration, T_D. Herein, the engine may be idling for a sufficient duration. During longer durations of engine idle, fuel vaporization may increase leading to substantial loading of the fuel vapor canister. Accordingly, canister load increases during the engine idle, and by t7 canister load is substantially at the threshold load (line 509). As such, the default idle purge flow rate may not be adequate. In response to the idling duration being at the threshold duration, T_D, the idle purge flow rate may be increased at t7 (plot 502). For example, the default purge flow rate at idle may be increased. In one example, the duty cycle of the CPV may be increased. In response to the increased purge flow rate, canister load may reduce between t7 and t8.

At t8, a tip-in event may occur as indicated by the sudden rise in engine speed signaling the end of engine idle condition. Accordingly, the CPV may be closed and the idle purge flow rate may be reset to its default rate at t8 (plot 502).

Thus, an example method for purging a fuel vapor canister may comprise, responsive to an indication of vapor slugs, reversing a direction of air flow through the fuel vapor canister in a vehicle while maintaining purge air intake at a vent line inlet. The indication of vapor slugs may include detecting one or more of a change in vehicle speed and a change in pressure in a fuel tank. Reversing the direction of air flow through the fuel vapor canister may comprise adjusting a conformation of a vent valve coupled between the fuel vapor canister and the vent line inlet, and adjusting a conformation of a reversing valve coupled between a fuel vapor canister buffer and an engine intake, such that purge air enters the fuel vapor canister through the fuel vapor canister buffer. The method may further include reversing the direction of air flow through the fuel vapor canister while maintaining purge air intake at a vent line inlet by reversing the direction of air flow though the fuel vapor canister while maintaining delivery of purge gasses to the engine intake in the vehicle. As such, reversing the direction of air flow through the fuel vapor canister while maintaining purge air intake at a vent line inlet may further include concurrently adjusting a conformation of the vent valve and a conformation of the reversing valve such that purge gasses exit the fuel vapor canister from a port not coupled to the fuel vapor canister buffer. The direction of air flow through the fuel vapor canister may be reversed for a pre-determined duration, and further, the direction of air flow through the fuel vapor canister may be restored to a first direction (e.g., forward direction) upon completion of the pre-determined duration. The method may further comprise, during engine idle, increasing an idle purge flow rate responsive to one of a duration of engine idle higher than a threshold duration and an amount of fuel vapor production higher than a vapor threshold. The method may further comprise restoring the idle purge flow rate in response to termination of engine idle.

In this way, a canister may continue to be purged even after receiving indication of release of one or more vapor slugs from the fuel tank. Reversing the direction of purge flow in response to the imminent presence of vapor slugs may enable adsorption of fuel vapors in the vapor slugs as the vapor slugs enter the canister. By adsorbing the fuel vapors in the vapor slugs, engine operation may be smoother and engine stall due to rich fuel vapors may be averted. Further, canister purge may be carried out more efficiently reducing a likelihood of bleed emissions. Overall, the engine may be emissions compliant and its drivability may be enhanced.

In another representation, a method may comprise purging a fuel vapor canister in a first direction when purging conditions are met, and in response to indication of a fuel tank vapor release greater than a threshold, purging the fuel vapor canister in a second direction, the second direction being opposite to the first direction. Herein, purging the fuel vapor canister in the first direction may include flowing fresh air from the fuel vapor canister towards a buffer, the buffer included within the fuel vapor canister at a first end of the fuel vapor canister. The method may further comprise, flowing the fresh air along with desorbed vapors from the fuel vapor canister towards an engine intake. Further, purging the fuel vapor canister in the second direction may include flowing fresh air from the buffer towards the fuel vapor canister.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for purging a fuel vapor canister, comprising:
responsive to an indication of vapor slugs determined via a controller,
reversing a direction of air flow through the fuel vapor canister in a vehicle via a valve while maintaining purge air intake at a vent line inlet, the valve adjusted via the controller.

2. The method of claim 1, wherein the indication of vapor slugs includes one of detection of a change in vehicle speed and a change in pressure in a fuel tank.

3. The method of claim 1, wherein reversing the direction of air flow through the fuel vapor canister comprises adjusting a conformation of a vent valve coupled between the fuel vapor canister and the vent line inlet via the controller, and adjusting a conformation of a reversing valve coupled between a fuel vapor canister buffer and an engine intake, such that purge air enters the fuel vapor canister through the fuel vapor canister buffer via the controller.

4. The method of claim 3, wherein reversing the direction of air flow through the fuel vapor canister while maintaining purge air intake at the vent line inlet includes reversing the direction of air flow though the fuel vapor canister while maintaining delivery of purge gasses to the engine intake in the vehicle via the controller.

5. The method of claim 4, wherein reversing the direction of air flow through the fuel vapor canister while maintaining purge air intake at the vent line inlet further includes concurrently adjusting a conformation of the vent valve and a conformation of the reversing valve such that purge gasses exit the fuel vapor canister from a port not coupled to the fuel vapor canister buffer via the controller.

6. The method of claim 5, further comprising reversing the direction of air flow through the fuel vapor canister for a pre-determined duration via the controller, and wherein the direction of air flow through the fuel vapor canister is restored to a first direction upon completion of the pre-determined duration as determined via the controller.

7. The method of claim 1, further comprising, during engine idle, increasing an idle purge flow rate responsive to one of a duration of engine idle higher than a threshold duration as determined via the controller and an amount of fuel vapor production higher than a vapor threshold as determined via the controller.

8. The method of claim 7, further comprising restoring the idle purge flow rate in response to termination of engine idle via the controller.

9. A system for an engine, comprising:
a fuel tank;
a fuel vapor canister comprising a fuel vapor canister buffer coupled to the fuel tank, the fuel vapor canister buffer arranged at a first end of the fuel vapor canister;
a purge line coupling the fuel vapor canister to an engine intake via a canister purge valve;
a vent line coupling the fuel vapor canister to a fresh air source;
a canister vent valve coupled between the fuel vapor canister and the vent line, the canister vent valve operable between a first conformation and a second conformation;
a reversing valve coupled between the fuel vapor canister buffer and the purge line, the reversing valve operable between a first conformation and a second conformation; and
a controller having executable instructions stored in a non-transitory memory for:
when canister purge conditions are met,
drawing air through the fuel vapor canister with the canister vent valve in the first conformation and with the reversing valve in the first conformation; and
in response to inferring fuel vapor release higher than a threshold vapor release from the fuel tank as determined via the controller,
drawing air through the fuel vapor canister with the canister vent valve in the second conformation and with the reversing valve in the second conformation.

10. The system of claim 9, wherein drawing air through the fuel vapor canister further comprises opening the canister purge valve.

11. The system of claim 10, wherein the controller includes further instructions for, responsive to an elapse of a pre-determined duration, ceasing drawing air through the fuel vapor canister with the canister vent valve in the second conformation and with the reversing valve in the second conformation.

12. The system of claim 11, wherein the canister vent valve fluidically couples the fuel vapor canister to the fresh air source when in the first conformation, and when in the second conformation, the canister vent valve fluidically couples the fuel vapor canister to the purge line.

13. The system of claim 12, wherein the reversing valve fluidically couples the fuel vapor canister buffer to the purge line when in the first conformation, and when in the second conformation, the reversing valve fluidically couples the fuel vapor canister buffer to the fresh air source.

14. A method for purging a fuel vapor canister, comprising:

coupling a first fuel vapor canister port to an engine intake;

coupling a second fuel vapor canister port to a fresh air source;

opening a canister purge valve coupled between the first fuel vapor canister port and the engine intake via a controller; and responsive to an indication of fuel vapor release from a fuel tank higher than a threshold vapor release as determined via the controller, coupling the second fuel vapor canister port to the engine intake and coupling the first fuel vapor canister port to the fresh air source via the controller.

15. The method of claim 14, wherein the first fuel vapor canister port is coupled to a fuel vapor canister buffer, and wherein the second fuel vapor canister port is not coupled to the fuel vapor canister buffer.

16. The method of claim 15, wherein the first fuel vapor canister port is fluidically coupled to the engine intake by a reversing valve in a first conformation coupled between the fuel vapor canister and the engine intake.

17. The method of claim 16, wherein the second fuel vapor canister port is fluidically coupled to the fresh air source by a canister vent valve in a first conformation coupled between the fuel vapor canister and the fresh air source.

18. The method of claim 17, wherein coupling the second fuel vapor canister port to the engine intake and coupling the first fuel vapor canister port to the fresh air source includes adjusting the reversing valve to a second conformation and concurrently adjusting the canister vent valve to a second conformation.

19. The method of claim 18, wherein adjusting the reversing valve to the second conformation and simultaneously adjusting the canister vent valve to the second conformation reverses a direction of air flow through the fuel vapor canister compared to placing the reversing valve in the first conformation and placing the canister vent valve in the first conformation.

* * * * *